United States Patent [19]

Chi

[11] 4,225,075

[45] Sep. 30, 1980

[54] HOOK-NAIL AND ITS DRIVING MACHINE

[76] Inventor: Hui-Neng Chi, No. 17, La. 119, Ta-Teh St., Taichung, Taiwan

[21] Appl. No.: 7,555

[22] Filed: Jan. 29, 1979

[51] Int. Cl.[3] ..... B25C 5/06

[52] U.S. Cl. ..... 227/119; 227/120; 227/132

[58] Field of Search ..... 227/119, 120, 128, 132, 227/147

[56] References Cited

U.S. PATENT DOCUMENTS

| | | | |
|---|---|---|---|
| 3,275,212 | 9/1966 | Johnson | 227/132 |
| 3,883,064 | 5/1975 | Hilgers | 227/120 |

*Primary Examiner*—Paul A. Bell

[57] ABSTRACT

This invention concerns a hook-nail and its driving machine having a specially designed hook-nail magazine, an impelling device and other components. The said impelling device, slidably mounted on an impelling ram and spring-energized, drives said hook-nail forward in a trough formed by said magazine and a U-shaped base until it is set against a check device for an adjacent bent driver to drive it out into the target surface.

6 Claims, 5 Drawing Figures

HOOK-NAIL AND ITS DRIVING MACHINE

BACKGROUND OF THE INVENTION

This invention relates to a hook-nail and its driving machine with spring-activated means for driving such hook-nails held in a magazine into a surface.

A conventional hook, with its screw end driven into a surface or object, easily becomes loosened after a long time of use if the said surface or object is not thick or strong enough. Damage or harm often results when the load is too much for a loosened hook. Though adhesive material is available for fastening a hook onto a surface or object, a hook so fixed is by nature incapable of sustaining any heavy thing. The need for a hook that can be easily and quickly driven into a surface to satisfy practical uses, especially when a series of hooks has to be so fastened, is above all felt in a factory or any other workshop. While machines of the stapler type have been developed in recent years, they can only drive inverted U-shaped staples. To accommodate a hook-nail as provided in this invention, a special driving machine has also to be devised.

SUMMARY OF THE INVENTION

The primary object of the present invention is to provide a kind of hook-nail that can be closely arranged one after another for discharge one by one and a machine that can drive it into a surface, solidly and enduringly planted to last long.

To realize this object, the hook-nail had better be so manufactured by present that it can be placed one after another closely in one orientation, with two symmetrically placed nails to enable effective driving, a suitable plane connecting the nails and the hook, the hook being formed out of said plane, an angle of about 90° between said hook and said nails to facilitate arrangement in the magazine and release by impelling the means of the hook-nail and to make it possible for the hook to form a suitable angle with the surface into which it is driven for eary use.

Another object of this invention is to provide a way in which hook-nails held in the supply box can be as much closely arranged as possible and discharged one by one by having each of the following hook-nails straddling the preceding one and leaving the front end of a hook-nail's plane uncovered by the following hook-nail to facilitate its being driven out. To make possible this overlapping arrangement, the width of the front part of the plane area or that part of the nail ends should be greater than that of the rear section of said plane which forms the hook part of the hook-nail. The recess on each side of said plane's front part should equal the thickness of the nails so that each hook-nail may be placed upon the foregoing one to enable the arrangement in the magazine of hook-nails in the manner envisioned in this invention.

An additional object of this invention is to provide a hook-nail transmission mechanism for the driving machine complete with various impelling components and a drive to strike a hook-nail out of the magazine into the target surface, to form a well-coordinated impelling and striking system.

According to this invention, the hook-nail should be made by presser, having two correspondingly positioned nails attached onto a plane, both lateral sides of which should recede the thickness of said nails to facilitate overlapping arrangement of hook-nails, with the other part of the plane forming a hook. Said nails should stand at an angle of about 90° against said plane.

Still another object of this invention is to provide a driver for the hook-nails and an impelling mechanism for said hook-nails; said driver geared to the spring device and having a bent-forward part for striking at said hook-nails and driving them out; said impelling mechanism located in the basal part of said driving machine comprising a hook-nail holding magazine, a guiding channel for said hook-nails, a spring energized striking device, an impelling device, a basal structure connected hingedly with the rear part of said magazine, a recovering spring for said magazine, and a check device to ease the discharge of hook-nails.

BRIEF DESCRIPTION OF THE DRAWING

Other objects and advantages of the present invention will become apparent from the following drawings and description.

DETAILED DESCRIPTION OF THE PREFERRED EMBODIMENTS

Figure 1:
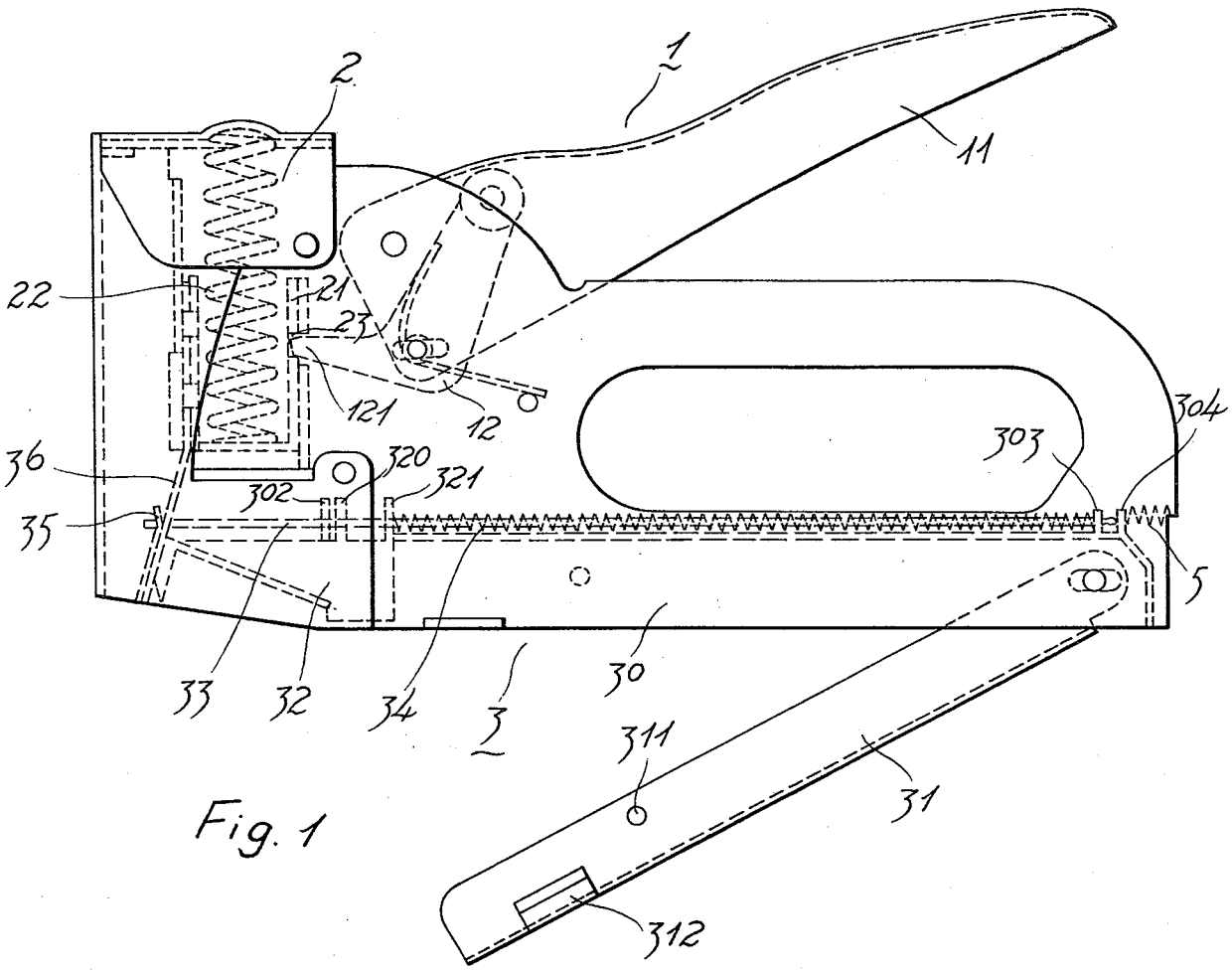
FIG. 1 is a view in perspective of the driving machine according to this invention.

With reference to FIG. 1 illustrating the driving machine according to this invention, said machine comprises an operating-handle mechanism 1, a spring-energized striking device 2, an impelling mechanism for hook-nails 3, said spring device 2 and said operating handle mechanism 1 being known structures requiring no description. Said impelling mechanism 3 incorporated into said machine's basal structure includes a magazine for hook-nails 30, a U-shaped basal structure 31, hinged to the rear end of said magazine 30 to form an integral whole to receive in said U-shaped trough 31 said magazine 30, an impelling device 32 straddling an impelling rod 33 positioned on the top of said magazine 30 for the purpose of impelling, by means of a spring device 34, hook-nails along in said magazine 30 until they reach the striking position, said impelling rod 33 also running through a check device 35 and a driver 36.

Figure 2:
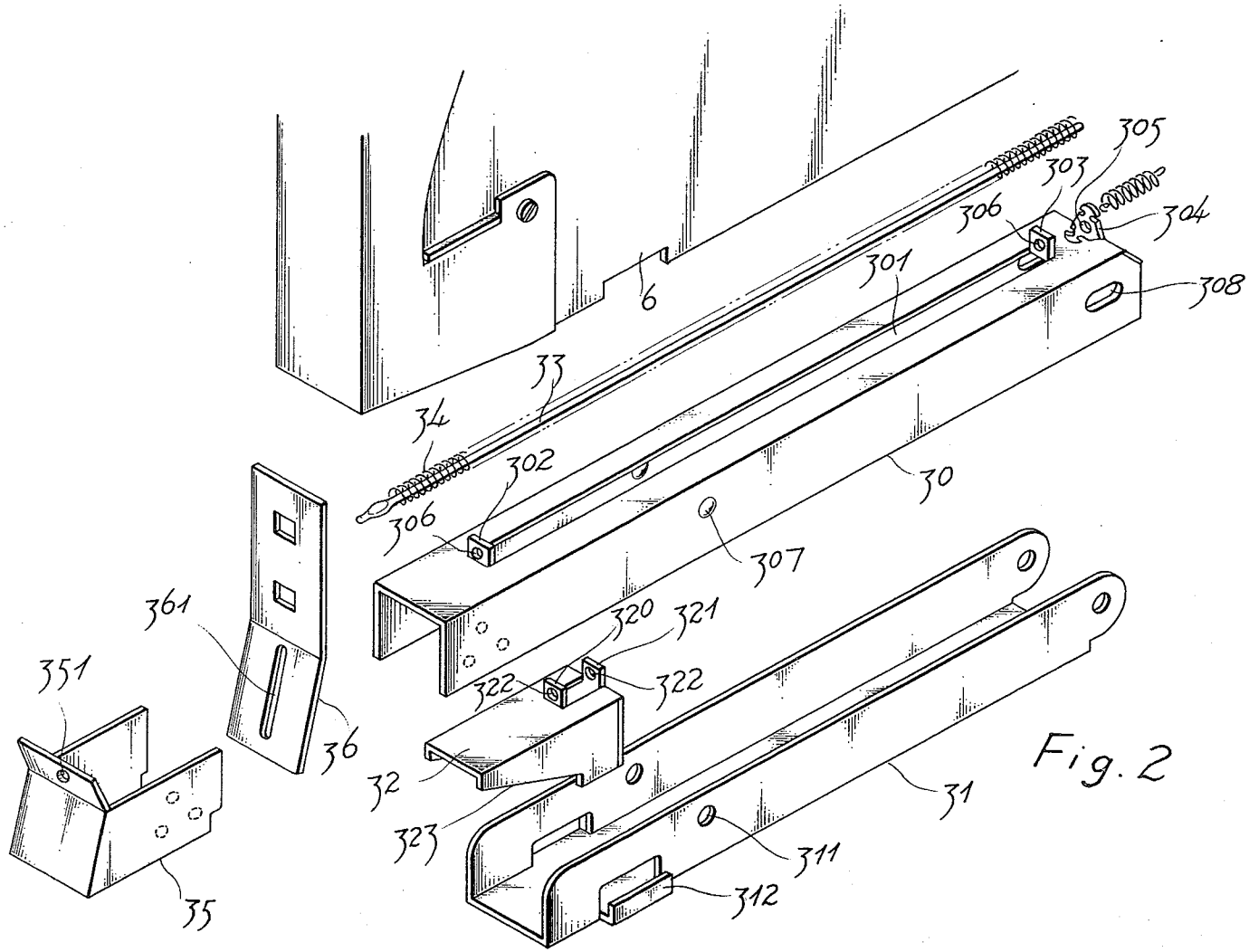
FIG. 2 is a view in perspective of the varions components of the driving machine's impelling mechanism according to this invention.

As illustrated by FIG. 2, the hook-nail magazine 30 is a long structure having its cross section shaped like ⊓, an elongated narrow opening 301 on its top with two small plates 302, 303 positioned at said opening's two ends, a plate 304 fixed at the rear end of said magazine 30's top having a hole 305 from which the impelling rod 33 goes on to pass through the holes 306 of said plates 302, 303, a raised spot 307 on either side of said magazine 30 to fit into a corresponding round hole 311 on either side of the basal structure 31, an oval hole 308 on either side of said magazine 30 serving to attach said basal part 31 to said magazine 30 with a latch and to ease the slide of said magazine 30, a check device 35 with a hole 351 fixed with rivets onto the sides of said magazine 30 to facilitate the upward and downward movement of a bent driver 36 which has a narrow opening 361 for said impelling rod 33 to pass through to have its end stopped and fixed by a small hole 351 on the check device 35. Said impelling device 32 has two plates 320, 321 on its top pierced by one hole 322 for said impelling rod to pass through so that said impelling device 32 fits inside said magazine 30 and slides forward and backward. The aforesaid spring 34 placed around said impelling rod 33 has its ends fixed between plate 303 and plate 321 to force forward said impelling device 32, which in turn impels hook-nails forward with its front end 323. Said driver 36 has its upper half fastened to a spring 2 and its narrow opening 361 enables its lower edge to rise over the hook-nail to be driven out. Said U-shaped basal structure 31 with its rear part attached with latches to the machine body's lower part has two holes 311 to fit onto raised spots 307 on either side of said magazine 30 as well as two fittings 312 protruding out of the machine's bottom 6 to ease the ejection of said U-shaped basal structure 31 for the purpose of replenishing the supply of hook-nails.

Figure 3:
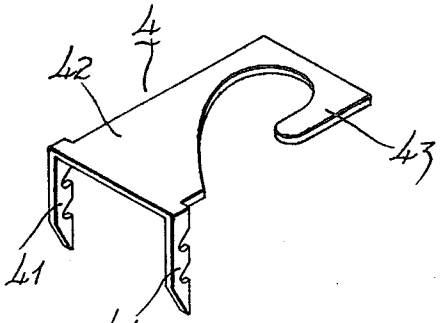
FIG. 3 is a view in perspective of the hook-nail in this invention.
Figure 4:
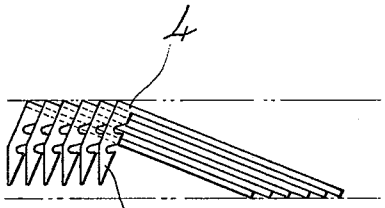
FIG. 4 illustrates the arrangement of hook-nails in their magazine in the present invention.

FIG. 3 shows the structure of the hook-nail in this invention. Said hook-nail 4, made by presser, has two symmetrical nails 41 on the front edge of a plane 42, the two sides of which behind the nails 41's root parts recede the thickness of the nails 41, with the other end of the plane forming a hook 43, said nails 41 and said plane 42 forming a suitable angle, preferably about 90°. Illustrative of how hooknails 4 are arranged in said magazine 30, FIG. 4 shows that a latter hook-nail is placed over a former, with their planes overlapping and the latter's nails 41 immediately behind the former's, each former hook-nail having the front edge of its plane left uncovered in order to receive the striking of said percussion plate 36.

Figure 5:
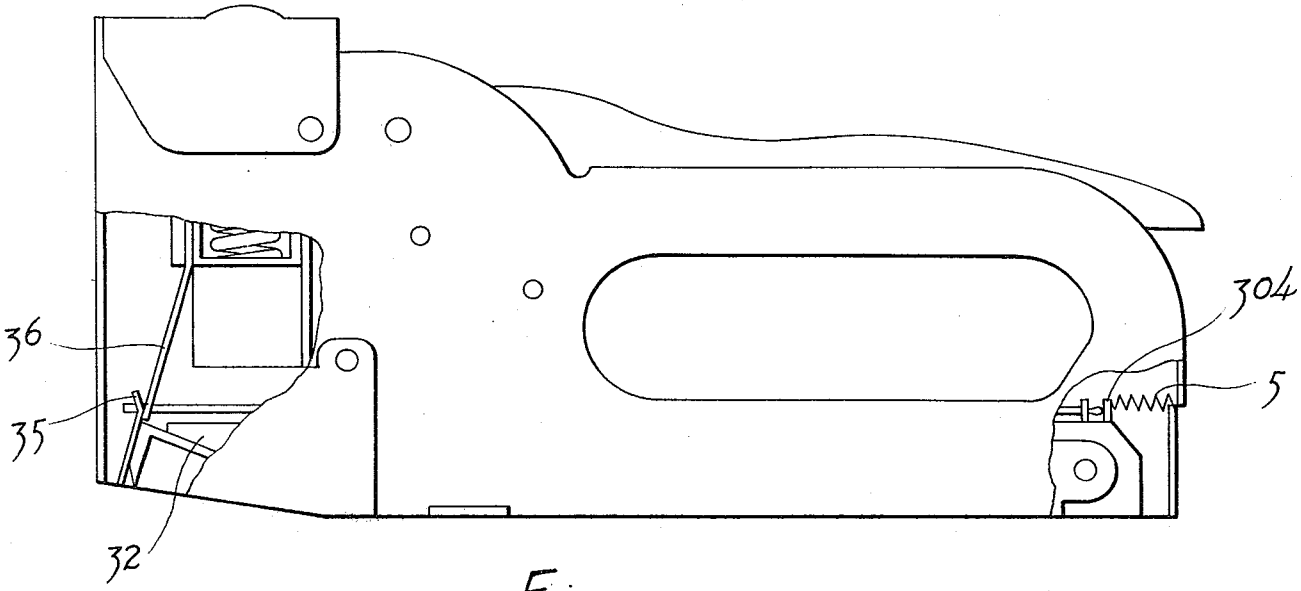
FIG. 5 illustrates the driving machine in operation according to this invention.

Referring again to FIG. 1, which shows that pressing downward the operating handle 11 of the operating handle mechanism will enable the front end 121 of a crank 12 to move upward the elastic panel 21 of the spring device 2 to compress a spring 22 and lift said driver 36 against said check device 35 so as to bring forward said magazine 30. Concurrent reference to FIG. 5 shows that the recovering spring 5 fixed between plate 304 and the machine's inner wall is extended, said spring 22's instant tension forces said driver 36 to strike onto the hook-nail below and drive it out as soon as the front end 121 of said crank 12 slips off the indent 23, and said recovering spring 5 pulls the magazine 30 back to its original position.

Various changes may be made in the details of construction without departing from the spirit and scope of the invention as defined by the appended claims.

What I claim is:

1. A driving machine for driving hook-nails comprising: a frame having a basal plane, said frame being open at the basal plane;

spring-energized striking means, operating perpendicularly to said basal plane, mounted at one end of said frame;

operating handle means, rotatably mounted on said frame, said handle including crank means for firstly moving said striking means away from said basal plane and secondly releasing said striking means, whereby said spring energized striking means is firstly energized and secondly caused to exert a striking force toward said basal plane;

a hook-nail magazine slidingly mounted inside said frame adjacent to said basal plane, with one end of said magazine between said striking means and the basal plane, wherein hook-nails are sequentially disposed in overlapping relationship having nail-ends obliquely pointed toward the basal plane, the hooks being disposed obliquely substantially along said basal plane;

a basal structure, pivotally mounted to said frame at the frame end opposite the striking means, whereby the basal structure partially encloses said magazine, the basal structure defining an opening beneath the striking means, the opening being at least as large as the length of the hook-nail;

a check device, attached to the end of said magazine beneath the striking device, said check device enclosing the end of the magazine with a closing surface which is oblique to said basal plane, said check device being attached to the magazine so as to provide a transverse slot between the check device and the magazine beneath said striking means;

an impelling device, slidingly mounted within said magazine, the impelling device having a surface substantially conformally shaped to engage the outline of the hook-nail hook as the hook-nails are disposed in the magazine, the impelling device having a portion extending above the hook-nails on the side away from the basal plane, said extended portion having at least one hole with the hole axis parallel to the lengthwise direction of the magazine;

an impelling rod installed lengthwise of the magazine, said rod being attached to said check device, and passing through said at least one hole in said impelling device;

a compression spring, coaxially surrounding said impelling rod, whereby said impelling device is resiliently biased toward said check device;

a recovering spring attached to the frame at the end away from said striking means and attached to the end of said magazine which is not beneath said striking means, said recovering spring operating to resiliently bias said magazine toward the end of the frame away from said striking means; and a driver affixed to said striking means and moving with said striking means, said driver extending obliquely toward said basal plane, parallel to said oblique surface on the check device and passing through said slot between said check device and said magazine, said driver having a slot extending in the direction of motion of the striking means, said impelling rod passing through said slot and retaining the driver, whereby the driver may move with respect to the rod, said oblique driver sliding on the oblique closing surface of the check device attached to said magazine, the magazine being thereby caused to slide with respect to the frame as the striking means moves perpendicularly toward or away from the basal plane, the magazine and affixed check device being biased against said driver by said recovering spring, the motion of said driver extending away from the basal plane sufficiently that the hook-nails within the magazine may be sequentially urged beneath the driver by the action of said impelling device and said impelling spring and the motion of the driver toward the basal plane causing the hook-nails to be obliquely driven from the driving machine in a direction parallel to the oblique surface of the check device through the opening defined by said basal structure.

2. The driving machine as claimed in claim 1 further comprising two fittings on either side of the basal structure protruding out of the bottom of the machine body to ease ejection of said basal structure.

3. A driving machine as claimed in claim 1 further comprising a basal structure having a hole on each side and a magazine having raised spots on each side the ends of which are attached with latches to the machine frame so that the holes on either side of said basal structure may fit into the raised spots on either side of said magazine in order to have said basal structure solidly fastened.

4. The driving machine as claimed in claim 1 further comprising a hook-nail magazine having a cross section shaped ⊓, an elongated narrow opening on its top with two holed plates at the ends of said opening for the impelling rod to pass through so that said rod's end may be fastened against the plate on the top end of said magazine.

5. The driving machine as claimed in claim 4 further comprising an impelling device on the top of which are found two small holed plates through which the aforementioned impelling rod penetrates so that said impelling device may be guided by the long narrow opening on the top of said magazine while sliding along said magazine's inside trough.

6. The driving machine as claimed in claim 1 further comprising a check device having a bent-forward front edge on which a hole is provided to allow the penetration of the impelling rod and to fix said rod as well.

* * * * *